United States Patent [19]

Orabona

[11] 4,383,425

[45] May 17, 1983

[54] SAFETY DEVICE FOR COMBINATION LOCKS

[75] Inventor: Joseph J. Orabona, Mahwah, N.J.

[73] Assignee: Presto Lock, Inc., Garfield, N.J.

[21] Appl. No.: 256,943

[22] Filed: Apr. 23, 1981

[51] Int. Cl.[3] ..... E05B 17/00; E05B 37/02

[52] U.S. Cl. ..... 70/312; 70/431; 70/442

[58] Field of Search ..... 70/312, 431, 442, 444, 70/445, 315 , 316, 317, 318, 319; 292/288; 206/1.5, 807

[56] References Cited

U.S. PATENT DOCUMENTS 3,416,338 12/1968 Gehrie ..... 70/312
3,785,685 1/1974 MacDonald ..... 292/288
3,997,205 12/1976 MacDonald ..... 292/288
4,123,923 11/1978 Bako ..... 70/74

*Primary Examiner*—Robert L. Wolfe
*Attorney, Agent, or Firm*—Shapiro and Shapiro

[57] ABSTRACT

Safety devices are provided for use with combination locks of the type which permit the combination of the lock to be changed from the faceplate of the lock by manipulation of the same actuator which is employed for opening the lock. The safety devices include removable elements insertable into the lock and engageable with the actuator for preventing movement of the actuator to a combination-changing position, while permitting normal movement of the actuator required to open the lock.

11 Claims, 3 Drawing Figures

SAFETY DEVICE FOR COMBINATION LOCKS

BACKGROUND OF THE INVENTION

This invention relates to safety devices for preventing the combination of multiple dial combination locks of the type employed on luggage and the like from being changed.

Manufacturers of combination locks for luggage articles have long recognized that convenience and ease of operation are important factors contributing to the saleability of their products. Purchasers of luggage having combination locks have also demanded that the combination locks be provided with the facility for changing the combination. Many early combination locks incorporating a combination-changing feature employed a shift lever which projected out of the back of the lock frame and which enabled the combination dials to be uncoupled from associated sleeves so that they could be rotated to a new combination. (See, for example, U.S. Pat. No. 3,416,338 to Gehrie, issued Dec. 17, 1968, and assigned to the same assignee as the present invention.) However, this arrangement required that an opening be provided in the lining material of the luggage case to permit access to the shift lever, and required that the luggage case be opened before the combination of the lock could be changed, which was somewhat inconvenient. Accordingly, combination locks were developed in which the combination could be changed from the faceplate of the lock. An example of one such combination lock is disclosed in U.S. Pat. No. 4,123,923 to Bako, issued Nov. 11, 1979, and assigned to the assignee of the present invention.

The Bako lock comprises an actuator disposed on the faceplate of the lock which is movable from a rest position when the lock is on combination to open the lock, and is further movable in the same direction to a combination-changing position to enable the combination to be changed. The Bako lock also includes a depressible operator that is located within and protrudes from a slot in the faceplate of the lock that receives an eye member attached to the tongue of a hasp, and a stop mechanism that prevents movement of the actuator to the combination-changing position until the operator is depressed. When the hasp is in closed position (with the eye member inserted into the slot and engaged by a latching element) the tongue of the hasp covers the operator. When the actuator is operated to open the combination lock and the hasp is raised, the operator is exposed and may be depressed to enable the actuator to be moved to the combination-changing position.

Combination locks having combination-changing mechanisms have created problems for retailers and for manufacturers due to the natural tendency of customers to play with the combination locks of luggage articles on display. If a customer, either illicitly or inadvertently, changes the combination from the 0-0-0 combination normally set into the lock by the manufacturer when the lock is shipped, the combination may be lost.

To avoid this problem, the manufacturer of the Gehrie lock (the present assignee) employs a flat removable fiber washer press-fitted over the portion of the shift lever which projects from the back of the lock frame. The frame is formed of stamped metal and a portion of its back wall is outwardly bowed to provide clearance for the combination dials located within the housing formed by the frame and the faceplate. The washer is sized to abut this outwardly bowed portion to prevent movement of the shift lever to the combination-changing position until the washer is removed.

The manufacturer of the Bako combination lock described above (the assignee of the present invention) employs a small removable plastic tab inserted between the faceplate of the lock and an angled portion of the depressible operator. The tab has a portion formed to extend slightly into the slot and to engage a side of the slot to prevent the tab from falling out. Engagement between the angled portion and the tab prevents the operator from being depressed as required to enable the actuator to move to the combination-changing position. When the luggage article is sold, the plastic tab may be removed so that the combination-changing mechanism may be operated.

There are also combination locks having a combination-changing mechanism which is operated by the same actuator used for opening the lock, and which do not employ an operator which must be operated to enable the actuator to be moved to the combination-changing position, as does the Bako lock. In such combination locks, the actuator may be readily moved to the combination-changing position whenever the combination lock is on combination. It is desirable, therefore, to provide removable safety devices for such combination locks which prevent the premature operation of the combination-changing mechanism, and it is to this end that the present invention is directed.

SUMMARY OF THE INVENTION

Advantageously, the invention provides a simple, inexpensive, removable safety device for use with combination locks having a combination-changing mechanism which is operated by the same actuator which is used for opening the lock. The safety device may be inserted into an opening in the combination lock by a manufacturer when the lock is shipped, and it prevents actuation of the combination-changing mechanism until it is removed, without interferring with the normal operation of the actuator to open the lock.

Briefly stated, the invention provides a safety device for use with a combination lock of the type having a faceplate, a plurality of combination dials extending through slots in the faceplate, and a manually engageable actuator disposed on the faceplate, the actuator being movable from a rest position to an open position to open the combination lock and being movable to a combination-changing position to enable the dials to be rotated to a new combination. The safety device comprises a removable element insertable into an opening in the faceplate adjacent to the actuator for engaging the actuator to block its movement to the combination-changing position, thereby preventing the combination from being changed.

DESCRIPTION OF THE PREFERRED EMBODIMENTS

Figure 1:
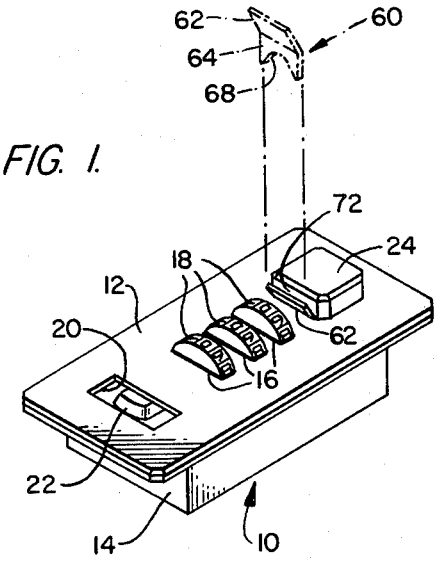
FIGS. 1 and 2 are perspective views illustrating first and second embodiments, respectively, of safety devices in accordance with the invention employed with associated combination locks.

Safety devices in accordance with the invention are primarily intended for use with multiple dial combination locks of the type which employ a single actuator both for opening the combination lock and for changing its combination. The figures illustrate safety devices in accordance with the invention employed with one such combination lock. As will become apparent, however, the particular construction of the internal mechanism of the combination lock is relatively unimportant to the invention, and the invention may be employed with combination locks having different constructions from that illustrated. Accordingly, the construction and operation of the combination lock will be described only insofar as is necessary to permit a full understanding of the invention.

As shown in the figures, a know combination lock 10 of the type with which the invention may be employed comprises a faceplate 12 having a frame 14 on its underside which houses the mechanism of the combination lock. The faceplate has a plurality of transverse slots 16 (best illustrated in FIG. 3) through which extends a plurality of combination dials 18. The faceplate also has a transverse slot 20 for receiving an eye member of an associated hasp (not illustrated). A movable latch element 22 is disposed below slot 20 (on the underside of the faceplate) for engaging the eye member to hold the hasp in closed position. A manually engageable actuator 24 is slideably disposed on the faceplate for operating the combination lock.

Figure 3:
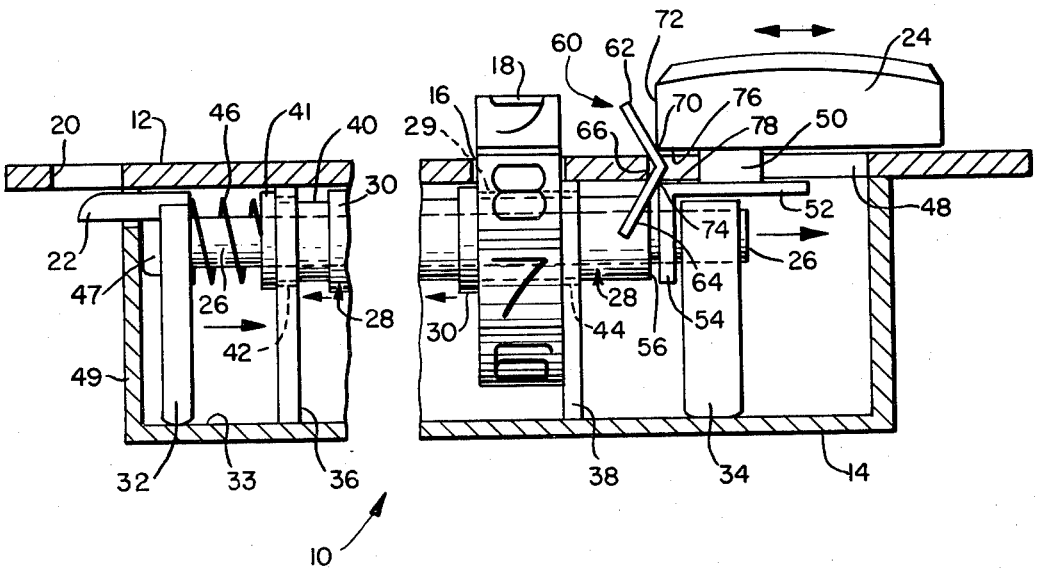
FIG. 3 is a fragmentary longitudinal sectional view of a combination lock illustrating the operation of the safety device in FIG. 1.

As shown in FIG. 3, each combination dial 18 may be rotatably supported on a longitudinally extending shaft 26, disposed on the underside of faceplate 12, by a flanged sleeve 28 which extends through a central opening 29 in the dial, the opening being slightly smaller than the flanged portion 30 of the sleeve. Each dial 18 is coupled to an associated sleeve 28, as by means of intermeshing teeth (not illustrated), for example, so that the dial and the sleeve rotate together about the shaft. As shown in FIG. 3, one end of the shaft (the left end in the figure) is connected to latch element 22 and to a vertical member 32 sized to support that end of the shaft on the bottom 33 of the frame. The opposite end of the shaft (the right end) is connected to another vertical support member 34 for supporting that end of the shaft on the frame. In addition, the frame may have a pair of upstanding brackets 36 and 38 for supporting the shaft at intermediate locations, as shown. A flanged bushing 40 may be located on the shaft near its left end and may extend through an opening 42 in bracket 36 and into engagement with the left-most sleeve 28, the flanged portion 41 of the bushing being slightly larger than opening 42, as shown. Similarly, bracket 38 may have an opening 44 therethrough for the right-most sleeve 28, as shown.

A coil spring 46 on the shaft between support member 32 and bushing 40 biases the flanged portion 41 of bushing 40 into engagement with bracket 36, and biases a depending portion 47 of latch element 22 into engagement with the end wall 49 of the frame. This locates the latch element in latching position, as illustrated in FIG. 3. Coil spring 46 also biases sleeves 28 into end-to-end abutting relationship, via bushing 40, and biases the right-most dial into engagement with bracket 38, as illustrated, by virtue of the engagement between the flanged portion 30 of the right-most sleeve and the side of the dial.

As is also shown in FIG. 3, faceplate 12 has an elongated opening or slot 48 through which a portion 50 of actuator 24 extends. A bracket 52 is attached to actuator potion 50 on the underside of the faceplate and has an angled portion 54 formed to be disposed on opposite sides of the shaft between support member 34 and end 56 of the right-most sleeve 28. When the combination lock is on combination, actuator 24 may be moved from its rest position (the position illustrated in FIG. 3) to the right. This causes portion 54 of bracket 52 to engage support member 34 and pulls the shaft to the right, as indicated by the arrow. As the shaft moves to the right, latch element 22 and support member 32 also move to the right, compressing coil spring 46 between support member 32 and the flanged portion 41 of bushing 40, and causing the latch element to disengage from the hasp eye to enable the hasp to be raised. When the actuator is released, the coil spring returns the shaft, the support members and the latch element back to the positions illustrated in FIG. 3.

The locking mechanism which prevents the combination lock from being opened except when it is on combination is not illustrated in FIG. 3, and there are many well-known locking mechanisms which may be used. For example, the shaft may be formed with a plurality of radially extending axially disposed tabs on its surface and sleeves 28 may have longitudinally extending slots adjacent to the shaft which are aligned with the tabs when the dials are on combination and receive the tabs when the shaft moves to the right to open the lock. When any dial is turned off combination, the slot of its associated sleeve will be out of alignment with a corresponding tab on the shaft, thus preventing movement of the shaft.

In order to change the combination of the lock, it is necessary to uncouple combination dials 18 from their associated sleeves 28 to enable the dials to be rotated independently of the sleeves to a new combination. This is accomplished as follows. When the combination lock is on combination, actuator 24 may be moved to the left from is rest position in FIG. 3 to a combination-changing position. As the actuator moves to the left, portion 54 of bracket 52 engages end 56 of the right-most sleeve 28, causing the sleeves and bushing 40 to slide on the shaft and also move to the left, compressing coil spring 46 between support member 32 and the flanged portion 41 of the bushing. (Movement of the shaft and support member 32 is prevented by the engagement between depending portion 47 of the latch element and end wall 49 of the frame.) This disengages the sleeves from the dials so that the dials may be rotated independently of the sleeves to the new combination. Actuator opening 48 in the faceplate, which may be a generally rectangular slot, is sized to enable actuator 24 to move from its rest position leftwardly (in FIG. 3) to the combination-changing position and rightwardly to the open position to open the lock.

As will be appreciated from the foregoing, it is very easy for someone to inadvertently, or intentionally, change the combination of the lock. The invention provides a safety device which is insertable into an opening in the faceplate of the lock adjacent to the actuator for engaging the actuator to prevent its movement to the combination-changing position.

As shown in FIG. 1, a safety device in accordance with a first embodiment of the invention may comprise an element or member 60 having first and second planar portions 62 and 64, respectively, formed at an angle to one another. Member 60, which may be formed of plastic or metal, for example, is adapted to be inserted into actuator opening 48 of the faceplate in the manner illustrated in FIG. 3. As shown, member 60 may have a relatively small thickness and is formed to be positioned along a transversely extending side 66 of the opening, with planar portion 64 located within the combination lock and planar portion 62 extending from the opening at an angle to the faceplate. As shown in FIG. 1, planar portion 64 may be formed with an arcuate cut-out 68 to enable planar portion 64 to be positioned on the rightmost sleeve 28 adjacent to its end 56, in the manner illustrated in FIG. 3, and to be supported by the sleeve.

As shown in FIG. 3, a lower edge 70 of a side 72 of actuator 24 engages planar portion 62, and a corner 74 of actuator bracket 52 engages planar portion 64, when the actuator is in rest position. Engagement between edge 70, corner 74, and the planar portions of member 60 blocks movement of the actuator to the left in FIG. 3 to its combination-changing position. If an attempt is made to force the actuator to the combination-changing position, edge 70 and corner 74 will tend to cause the planar portions of the member to bend around the edges of side 66 on opposite sides of the faceplate. Member 60, in cooperation with the faceplate, will then act as a wedge and will be jammed between the bottom 76 of the actuator and the top 78 of bracket 52 to block movement of the actuator to the left in FIG. 3. Member 60, however, does not block the movement of the actuator to open position (to the right in the figure).

Preferably, member 60 is sized with respect to opening 48 such that it is tightly confined by the sides of the opening to prevent it from falling out. If desired, transversely extending tabs may also be provided on the sides of planar portion 64 of the member to hook to or abut the underside of the faceplate. In any event, it is desirable that member 60 be sized with respect to the opening such that some amount of force is required for its removal, thereby discouraging "playful customers" from changing the combination. When the luggage article to which the combination lock is affixed is sold, member 60 may be removed to enable normal operation of the combination-changing mechanism.

To install member 60 within the combination lock, actuator 24 may be moved to open position to enable member 60 to be positioned within opening 48, as shown in FIG. 3. Upon releasing the actuator, coil spring 46 will move the actuator back towards its rest position until edge 70 and corner 74 contact planar portions 62 and 64, respectively.

Figure 2:
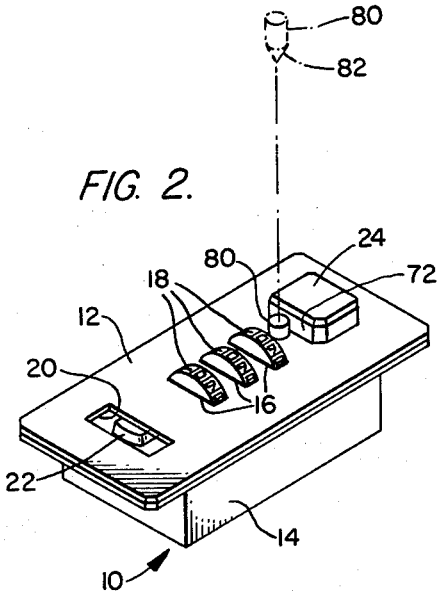

FIG. 2 illustrates a second embodiment of a safety device in accordance with the invention. As shown, the safety device may comprise an element 80 shaped as a generally cylindrical plug, and faceplate 12 of the combination lock may have a hole (not illustrated) adjacent to side 72 of the actuator for receiving the plug, in the manner illustrated in FIG. 2. The plug, which may be formed of plastic, for example, may have a tapered end 82 to facilitate its insertion into the hole. Preferably, the plug is sized for a tight fit in the hole to prevent it from falling out. Plug 80 functions in a manner similar to member 60 to block movement of the actuator to the combination-changing position. Member 60 has an advantage over plug 80 in that it is unnecessary to provide a separate hole in the faceplate for the member.

As will be appreciated, safety devices in accordance with the invention are relatively simple and inexpensive devices. Yet, they admirably serve the function for which they are intended.

While preferred embodiments of the invention have been shown and described, it will be apparent to those skilled in the art that changes can be made in these embodiments without departing from the principles and spirit of the invention, the scope of which is defined in the appended claims.

The invention claimed is:

1. For use with a combination lock of the type having a faceplate, a plurality of combination dials extending through slots in the faceplate, and a manually engageable actuator disposed on the faceplate, the actuator being movable from a rest position to an open position to open the combination lock and being movable to a combination-changing position to enable the dials to be rotated to a new combination, a safety device for preventing the combination from being changed, comprising a removable element insertable into an opening in the faceplate adjacent to the actuator and being engageable with the actuator to block movement of the actuator to the combination-changing position.

2. The device of claim 1, wherein the actuator is slideably disposed on the faceplate and the faceplate has a slot therein for the actuator, the slot being sized to enable the actuator to move to the open and to the combination-changing positions, and wherein said slot comprises said opening for the element.

3. The device of claim 1, wherein said element is sized for a tight fit in said opening.

4. The device of claim 1, wherein the element comprises a member having first and second planar portions formed at an angle to one another.

5. The device of claim 4, wherein the combination lock has a longitudinally extending shaft located on the underside of the faceplate, and a plurality of sleeves on the shaft for rotatably supporting the dials on the shaft, and wherein the first planar portion of the member has an arcuate cut-out in an edge thereof for receiving an adjacent sleeve to enable the member to be supported on the adjacent sleeve when it is inserted into said opening.

6. The device of claim 5, wherein the first planar portion is sized such that when it is supported on the adjacent sleeve, the second planar portion extends from said opening at an angle to the faceplate.

7. The device of claim 6, wherein the member is formed such that the second planar portion engages the actuator and the first planar portion engages another member attached to the actuator to block movement of the actuator to the combination-changing position.

8. The device of claim 1, wherein the actuator moves in a first direction to open position and moves in a second direction to combination-changing position, and wherein the element is ineffective to block movement of the actuator to open position.

9. The device of claim 1, wherein the element is a plug and the opening in the faceplate comprises a hole for the plug.

10. The device of claim 1 or 4, wherein the element is formed of plastic.

11. The device of claim 1 or 4, wherein the element is formed of metal.

* * * * *